United States Patent [19]

Eriksson

[11] 4,298,097

[45] Nov. 3, 1981

[54] ESCAPE-LADDER

[76] Inventor: Lars O. Eriksson, Sigyns väg 5c, 149 00, Nynäshamn, Sweden

[21] Appl. No.: 129,348

[22] Filed: Mar. 11, 1980

[51] Int. Cl.[3] ..... E06C 1/56

[52] U.S. Cl. ..... 182/198; 182/70

[58] Field of Search ..... 182/198, 197, 196, 70–76, 182/228, 46

[56] References Cited

U.S. PATENT DOCUMENTS

| | | | |
|---|---|---|---|
| 190,342 | 5/1877 | Lake | 182/198 |
| 406,257 | 7/1889 | Butler | 182/198 |
| 406,765 | 7/1889 | Parry | 182/197 |
| 800,934 | 10/1905 | McArthur | 182/198 |
| 2,887,261 | 5/1959 | McGuire | 182/198 |
| 3,031,029 | 4/1962 | Davis | 182/198 |
| 3,415,341 | 12/1968 | Hostetler | 182/198 |
| 4,143,741 | 3/1979 | Souza | 182/198 |
| 4,157,130 | 6/1979 | Aberer | 182/198 |

*Primary Examiner*—Reinaldo P. Machado

*Attorney, Agent, or Firm*—LeBlanc, Nolan, Shur & Nies

[57] ABSTRACT

A device at an unfoldable escape-ladder assembled of rungs (1), the ends of which are attached between flexible lateral members (2), preferably steel wires, said rungs (1) being longish and of plate-shaped material and capable to be stacked, the upper portion of the escape-ladder intended to be attached to a wall (4), a stay or the like, which escape-ladder in folded state having its rungs (1) lying stacked and each of the steel wires (2) forming a ring for each rung (1), which escape ladder is provided with a means for releasing the ladder. According to the invention, each rung (1 ) has substantially S-shaped cross-section, where the free ends of the S-shaped portion (7) are extended so as to form two parallel legs (8,9), and that the steel wires (2) are attached on the rungs (1) with their substantial longitudinal direction perpendicular to said legs. In unfolded state of the ladder and upper one (8) of said legs constitutes a tread and the lower one (9) constitutes a distance member for maintaining the ladder at a certain distance from a wall or the like, along which the ladder is unfolded.

4 Claims, 4 Drawing Figures

Fig. 1
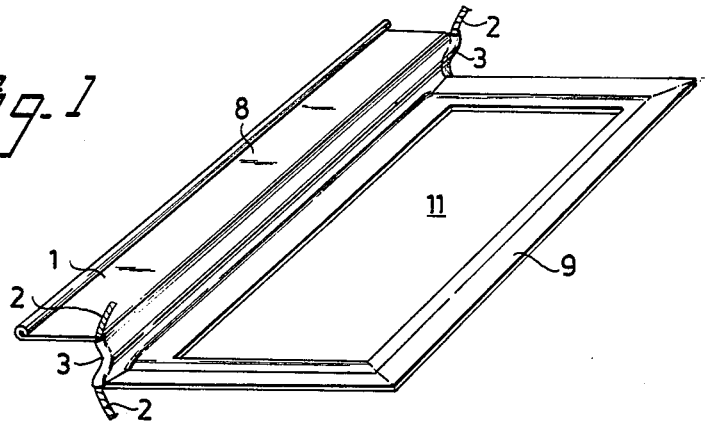
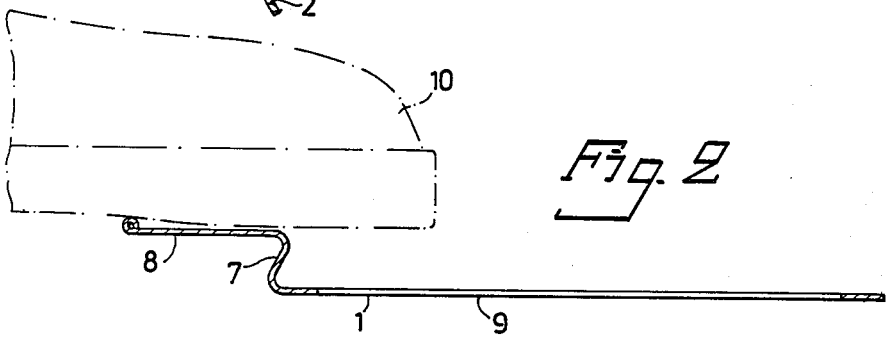
Fig. 2
Fig. 3
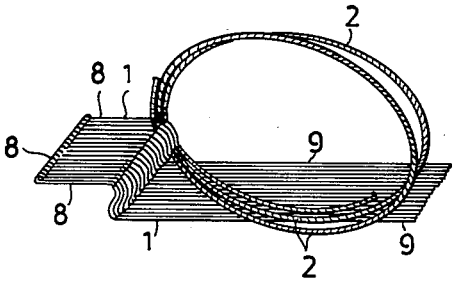
Fig. 4
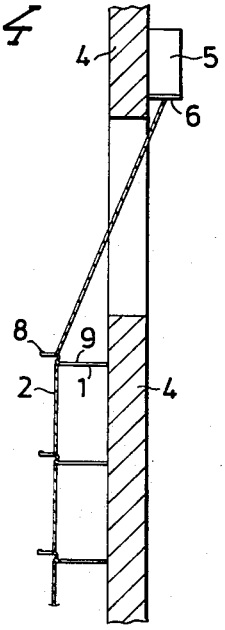

ESCAPE-LADDER

This invention relates to a device at an unfoldable escape-ladder, which is assembled of rungs, the ends of which are attached between two flexible lateral members, such as steel wires.

In Swedish patent No. 7609898-6 and Swedish patent application 7902879-1 filed in Sweden on Mar. 30, 1979, the priority application for copending U.S. application Ser. No. 129,349, filed Mar. 11, 1980, an unfolded escape-ladder of the aforesaid kind is disclosed. Its rungs are longish pieces of a plate-shaped material, such as iron sheet metal, which has been bent to W-section. The ends of the rungs are provided with tubes, which are bent to wavy turns and arranged tightly and firmly to enclose the flexible lateral members, i.e. the steel wires. The W-section of the rungs is such as to permit the rungs to be stacked.

Upon stacking a number of rungs, the steel wires on both sides of the rungs form a number of rings located to the side of each other, so that a tubular body is formed of the steel wire located on each side of the rungs.

The escape-ladder according to the above patent is intended to be attached at its upper portion to a building, preferably inside and above a window, and for its utilization to be thrown out and thereby to position itself along the building wall.

Due to the short extension of the W-shaped steps in horizontal direction of a ladder suspending, for example, along a building wall, considerable difficulties can arise when climbing down the ladder.

The present invention solves the aforesaid problem, at the same time as the rungs can be stacked and the other advantages of such an escape-ladder are maintained.

The present invention, thus, relates to an escape-ladder, which is assembled of rungs, the ends of which are attached between flexible lateral members, preferably steel wires, which rungs are longish and of plate-shaped material and can be stacked side against side, of which escape-ladder the upper portion is intended to be attached to a wall, a stay or the like, and which escape-ladder in folded state has its rungs lying stacked and forming with each of the steel wires a ring for each rung.

The invention is characterized in that each rung has substantially S-shaped cross-section, at which the free ends of the S-shaped portion are extended so that two parallel legs are formed, and that the steel wires are attached to the rungs so that their substantial longitudinal direction is perpendicular to said legs, so that in unfolded state of the ladder the upper one of said legs constitutes the tread and the lower one constitutes a distance member to maintain the ladder at a certain distance from a wall or the like, along which the ladder is unfolded.

The invention is described in greater detail in the following, with reference to the accompanying drawing, in which FIG. 1 is a perspective view of a rung, FIG. 2 is a cross-section centrally of a rung, FIG. 3 is an end view of an escape-ladder comprising a plurality of stacked rungs and rings formed by steel wires, FIG. 4 shows the ladder in unfolded state.

In FIG. 1 a rung 1 is shown made of longish pieces of iron sheet metal and having S-shaped cross-section. The rungs 1 are attached suitably spaced between two flexible lateral members, such as steel wires 2, in that the end edges 3 of the rungs are bent about each wire 2 so that a wavy tube is formed about each wire 5.

The rungs 1 can be stacked side against side as shown in FIG. 3. In folded state, as shown in FIG. 3, the rungs 1 are lying stacked, and each of the steel wires 2 forms a ring for each rung 1. The escape-ladder is attached at its upper portion to a wall 4 of a building or the like.

In folded state, the rungs are enclosed by a housing 5, the bottom 6 of which is hinged to be opened where the bottom can be provided with a spring catch or the like.

The said catch is so arranged that a certain force must be applied to the bottom for causing the same to open, and so that said force exceeds the force exerted by a folded ladder on the bottom.

In folded state, namely, said rings act as springs, which tend to unfold the ladder. This effect implies at the release of the ladder by the spring action, that the ladder is unfolded rapidly and efficiently in its entire length.

According to the present invention, each rung 1 has substantially S-shaped cross-section, see FIGS. 1 and 2. The free ends of the S-shaped portion 7 are so extended as to form two parallel legs 8,9.

The steel wires 2 are attached on the rung through the end edges 3. The steel wires 2, thus, are attached on the rungs with their substantial longitudinal direction perpendicular to the legs 8,9.

It is obvious, thus, that the ladder in unfolded state will be suspended so that the legs 8,9 extend substantially horizontally.

The upper one of said legs 8 constitutes the tread for a foot 10, indicated by a dashed line in FIG. 2, and the lower one 9 constitutes in unfolded state of the ladder a distance member from the wall 4 or the like, along which the ladder is unfolded.

In FIG. 1 is shown that the leg 9 constituting a distance member has a punched out surface 11 in order to render it possible, that a hand can embrace the portion of the rung 1 which constitutes a tread.

The punched out surface 11 may be substantially smaller than the surface of the leg 9, but must be located at least close to the S-shaped portion 7.

The rung 1 according to an embodiment of the invention can be designed so that the centre of gravity for the rung is located in or at the S-shaped portion 7. The leg 9 constituting a distance member is 1,5 to 6 times longer than the other one 8 of the legs, preferably 4 times longer.

The escape-ladder, as appears from FIG. 3, is in folded state very compact. In unfolded state it offers a very steady ladder at a distance from a wall or the like, whereby the disadvantages mentioned above in the introductory portion are eliminated.

The present invention must not be regarded restricted to the embodiments described above, but can be varied within its scope defined in the attached claims.

I claim:

1. An escape-ladder assembled of rungs (1), the ends (3) of which are attached between flexible lateral members (2), preferably steel wires, which rungs (1) are longish and of plate-shaped material and can be stacked side against side, the upper portion of the escape-ladder intended to be attached to a wall (4), a stay or the like, which escape-ladder in folded state has its rungs (1)

lying stacked and each of the steel wires (2) forming a ring for each rung (1), characterized in that each rung (1) has substantially S-shaped cross-section, where the free ends of the S-shaped portion (7) are extended so as to form parallel upper and lower legs (8,9), and that the steel wires (2) are attached on the rungs (1) with their substantial longitudinal direction perpendicularly to said legs, so that in unfolded state of the ladder the upper one (8) of said legs constitutes a tread and the lower one (9) constitutes a distance member for maintaining the ladder at a certain distance from a wall (4) or the like, along which the ladder is unfolded.

2. An escape-ladder as defined in claim 1, characterized in that the leg (9) constituting the distance member has a punched out surface (11) at least close to the S-shaped portion (7) of the rung (1) in order to render it possible for a hand to embrace the portion (8) of rungs (1) which constitutes the tread.

3. An escape-ladder as defined in claim 1, characterized in that the leg (9) constituting the distance member is 1,5–6 times longer than the other leg (8), preferably 4 times longer.

4. An escape-ladder as defined in claim 2, characterized in that the rung (1) is formed so that its centre of gravity is located in or at the S-shaped portion (7).

* * * * *